US009272523B2

(12) United States Patent
Sanaei et al.

(10) Patent No.: US 9,272,523 B2
(45) Date of Patent: Mar. 1, 2016

(54) PRINTER CONFIGURED FOR OPTIMIZED PRINTING

(71) Applicant: MEMJET TECHNOLOGY LIMITED, Dublin (IE)

(72) Inventors: Kianoush Mir Sanaei, San Diego, CA (US); Patrick McAuliffe, North Ryde (AU)

(73) Assignee: Memjet Technology Ltd. (IE)

( * ) Notice: Subject to any disclaimer, the term of this patent is extended or adjusted under 35 U.S.C. 154(b) by 0 days.

(21) Appl. No.: 14/663,198

(22) Filed: Mar. 19, 2015

(65) Prior Publication Data

US 2015/0283819 A1 Oct. 8, 2015

Related U.S. Application Data

(60) Provisional application No. 61/973,984, filed on Apr. 2, 2014.

(51) Int. Cl.
*B41J 2/175* (2006.01)
*B41J 2/18* (2006.01)

(52) U.S. Cl.
CPC ..... *B41J 2/17596* (2013.01)

(58) Field of Classification Search
CPC ..... B41J 2/175; B41J 2/17596; B41J 2/1707; B41J 2/18; B41J 2202/12; B41J 2202/20
USPC ..... 347/22, 23, 84, 85, 89
See application file for complete search history.

(56) References Cited

U.S. PATENT DOCUMENTS

| | | | | |
|---|---|---|---|---|
| 4,910,529 | A | 3/1990 | Regnault | |
| 5,956,062 | A * | 9/1999 | Omata et al. | 347/89 |
| 6,179,406 | B1 * | 1/2001 | Ito et al. | 347/35 |
| 7,401,907 | B2 * | 7/2008 | Perez | 347/84 |
| 8,845,083 | B2 * | 9/2014 | Lucas et al. | 347/89 |
| 8,926,072 | B2 * | 1/2015 | Balala et al. | 347/85 |
| 2008/0239013 | A1 | 10/2008 | Hirashima | |
| 2011/0277303 | A1 | 11/2011 | Mallory et al. | |
| 2012/0194619 | A1 | 8/2012 | Smith et al. | |

FOREIGN PATENT DOCUMENTS

| | | | |
|---|---|---|---|
| EP | 2193924 | A1 | 6/2010 |
| EP | 2540508 | A1 | 1/2013 |

OTHER PUBLICATIONS

International Search Report and Written Opinion for PCT/EP2015/056163 issued May 28, 2015, 13 pages.

* cited by examiner

*Primary Examiner* — Anh T. N. Vo
(74) *Attorney, Agent, or Firm* — Cooley LLP

(57) ABSTRACT

An inkjet printer includes a printhead having first and second ports; an ink container for supplying ink to the printhead, the ink container having a supply port and a return port; a first ink conduit interconnecting the supply port and the first port; a second ink conduit interconnecting the return port and the second port; an ink valve positioned in the first ink conduit; a first pump positioned in the second conduit; and a second pump positioned in a valve bypass conduit. The first and second pumps are employed during pressurized priming of the printhead so as to optimize a pressure gradient along a length of the printhead.

20 Claims, 5 Drawing Sheets

PRINTER CONFIGURED FOR OPTIMIZED PRINTING

FIELD OF THE INVENTION

This invention relates to an ink delivery system for an inkjet printer. It has been developed primarily for optimizing priming of all nozzles across a pagewidth printhead.

BACKGROUND OF THE INVENTION

Inkjet printers employing Memjet® technology are commercially available for a number of different printing formats, including small-office-home-office ("SOHO") printers, label printers and wideformat printers. Memjet® printers typically comprise one or more stationary inkjet printheads, which are user-replaceable. For example, a SOHO printer comprises a single user-replaceable multi-colored printhead, a high-speed label printer comprises a plurality of user-replaceable monochrome printheads aligned along a media feed direction, and a wideformat printer comprises a plurality of user-replaceable multi-colored printheads in a staggered overlapping arrangement so as to span across a wideformat pagewidth.

Providing users with the ability to replace printheads is a key advantage of the Memjet® technology. However, this places demands on the ink delivery system supplying ink to the printhead(s). For example, the ink delivery system should allow expired printheads to be de-primed before replacement so as not to cause inadvertent ink spillages and allow new printheads to be primed with ink after installation.

A number of approaches towards ink delivery systems for inkjet printheads have been described in US2011/0025762; US2011/0279566; and US2011/0279562 (all assigned to the present Applicant), the contents of which are incorporated herein by reference.

The ink delivery systems described previously in connection with Memjet® printers generally comprise a closed loop system having first and second ink conduits interconnecting an ink container with respective first and second ink ports of the printhead. A reversible pump is positioned in the second ink conduit for pumping ink around the closed loop. Typically, a pinch valve is positioned on the first ink conduit for controlling the flow of ink or air through the printhead. As described in US2011/0279566 and US2011/0279562, the pump and pinch valve are coordinated to provide a multitude of printhead priming, de-priming and other maintenance or recovery operations.

It would be desirable to modify the ink delivery systems described in US2011/0279566 and US2011/0279562 so as to improve so-called 'pulse priming' or 'pressure priming' operations in which ink is forced from all nozzles in the printhead under a positive pressure.

SUMMARY OF THE INVENTION

In accordance with the present invention, there is provided an inkjet printer comprising:

a printhead having a first port positioned towards a first end and a second port positioned towards an opposite second end;

an ink container for supplying ink to the printhead, the ink container comprising a supply port and a return port;

a first ink conduit interconnecting the supply port and the first port;

a second ink conduit interconnecting the return port and the second port;

an ink valve positioned in the first ink conduit for controlling ink flow between the ink container and the first port, wherein the first ink conduit has a first section between the ink container and the valve, and a second section between the valve and the first port;

a first pump positioned in the second conduit; and a second pump having a first pump inlet connected to the first section and a first pump outlet connected to the second section.

The printer according to the present invention advantageously provides optimized pressure-priming of the printhead using the first and second pumps, whilst still enabling a range of ink circulation, de-priming and printing operations. In particular, the printhead experiences a relatively more uniform pressure along its length during pressure-priming operations compared to the single pump ink delivery systems described in the prior art. This relatively more uniform pressure improves the efficiency of pressure-priming, consumes less ink, and enables lower powered pumps to be employed. The benefits of the present invention are realized most particularly with pagewidth printheads having a length of about 200 mm or more. The dual pump arrangement of the present invention may be used, for example, for recovering blocked nozzles in the printhead and/or fully priming nozzles of a new printhead which has been freshly installed in the printer.

As used herein, references to 'ink' will be taken to include any printable fluid for creating images and indicia on a media substrate, as well as any functionalized fluid such as fixatives, infrared inks, UV inks, surfactants, medicaments, 3D-printing fluids etc.

Preferably, the first pump is a peristaltic pump positioned in the second conduit. Typically, the peristaltic pump is reversible and configured to pump ink through the second conduit when actuated and to shut off the second conduit when not actuated.

As described in US2014/0009538, the first pump may be positioned above a height of the printhead. Positioning the first pump above the height of the printhead advantageously moves bubbles towards the pump in a direction generally corresponding to the natural buoyancy of air bubbles during ink circulation operations.

Preferably, the second pump is a peristaltic pump having a similar pumping power to the first pump in order to provide similar pressure gradients on either side of a center-point of the printhead. In contrast with the first pump, the second pump is only required to pump ink in one direction in the preferred embodiment of the present invention. Therefore, the second pump may be non-reversible. By analogy with the first pump, the second pump configured to pump ink when actuated and to act as a shut-off valve when not actuated.

The second ink conduit generally comprises a third section between the second port and the first pump and a fourth section between the first pump and the return port of the ink container. The third section may be wholly at or above the height of the printhead in order to assist with air bubble removal, as described in US2014/0009538.

Preferably, the ink container is positioned below a height of the printhead.

Preferably, the ink container is maintained at atmospheric pressure (e.g. open to atmosphere), such that ink is supplied to the printhead under gravity and at negative hydrostatic pressure during normal printing.

The printer may comprise an ink reservoir (e.g. a replaceable ink cartridge or ink tank) in fluid communication with the ink container.

Preferably, the printer comprises a pressure-regulating system for controlling a height of ink in the ink container relative to the printhead.

Preferably, the pressure-regulating system comprises a regulator valve for controlling a flow of ink into the ink container from the ink reservoir. For example, the regulator valve may comprise a float valve positioned in the ink container for regulating a flow of ink into a supply inlet of the ink container (see, for example, US2011/0279566 and U.S. Pat. No. 7,887,170, the contents of which are incorporated herein by reference). Alternatively, the pressure-regulating system may be a particular configuration (e.g. flattened profile) of the ink container for maintaining a substantially constant height of ink in the ink container relative to the printhead (see, for example, US2011/0279562, the contents of which are incorporated herein by reference).

Preferably, the printer further comprises:

an air conduit connected to the second section of the first ink conduit, the air conduit having an air inlet in fluid communication with atmosphere; and an air valve for controlling a flow of air through the air conduit.

Preferably, the ink valve is a pinch valve. Preferably, the air valve is a pinch valve.

Preferably, the ink and air valves are contained in a multi-channel pinch valve arrangement configured for pinching at least one of: the air conduit and the second section of the first ink conduit. The multi-channel pinch valve arrangement may be, for example, as described in US2011/0279566; US2011/0279562 or U.S. application Ser. No. 14/097,499, the contents of which are incorporated herein by reference).

In one embodiment the printer comprises:

at least first and second printheads;

a common ink supply line connected to the ink container; and a common ink return line connected to the ink container;

a first fluidic loop connecting the first printhead to the common ink supply line and the common ink return line via respective first and second ink conduits; and a second fluidic loop connecting the second printhead to the common ink supply line and the common ink return line via respective first and second ink conduits;

wherein each of the first and second fluidic loops comprises a respective first pump, second pump and ink valve.

Preferably, the printer further comprises a controller for controlling operation of the first pump, the second pump, the ink valve and the air valve.

Preferably, the controller is configured to coordinate a pressurized priming operation, the pressurized priming operation comprising the steps of:

closing the ink and air valves;

actuating the second pump to pump ink towards the first port of the printhead; and actuating the first pump in a reverse direction to pump ink towards the second port of the printhead, wherein the first and second pumps are actuated simultaneously.

Preferably, the controller is configured to coordinate an ink circulation operation, the ink circulation operation comprising the steps of:

closing the air valve;

opening the ink valve; and actuating the first pump only in a forward direction to draw ink from the supply port, through the printhead and towards the return port.

Preferably, the controller is configured to actuate that second pump in a forward direction during the ink circulation operation. Preferably, the first pump has a higher pump speed than the second pump during the ink circulation operation.

Preferably, the controller is configured to coordinate a de-priming operation, the de-priming operation comprising the steps of:

opening the air valve;

closing the ink valve; and actuating the first pump in a forward direction to draw air from the air conduit and through the printhead.

Preferably, the controller is configured to close the air valve, open the ink valve and de-actuate the first and second pumps for a printing operation.

Preferably, a first air compliance chamber communicates with the second conduit between the first pump and the second port. The first air compliance chamber dampens pressure waves during ink circulation/flushing operations, as described in US2014/0009538.

An additional second air compliance chamber may be in communication with the first conduit between the second pump and the first port. The second air compliance chamber, when present, may be either connected to a second section of the first conduit or connected to a second pump outlet line. However, it has been found that the second air compliance chamber is usually not necessary for dampening pressure waves.

In a second aspect, there is provided a method of pressure-priming a printhead having first and second ports positioned towards either end thereof, the method comprising the steps of:

pumping ink towards the second port using a first pump; and simultaneously pumping ink towards the first port using a second pump, wherein a minimum priming pressure is experienced by nozzles positioned at about the center of the printhead and a maximum priming pressure is experience by nozzles positioned adjacent the first and second ports of the printhead.

BRIEF DESCRIPTION OF THE DRAWINGS

Embodiments of the present invention will now be described by way of example only with reference to the accompanying drawings, in which.

DETAILED DESCRIPTION OF THE INVENTION

Printer Having Pump and Pinch Valve Arrangement

Figure 1:
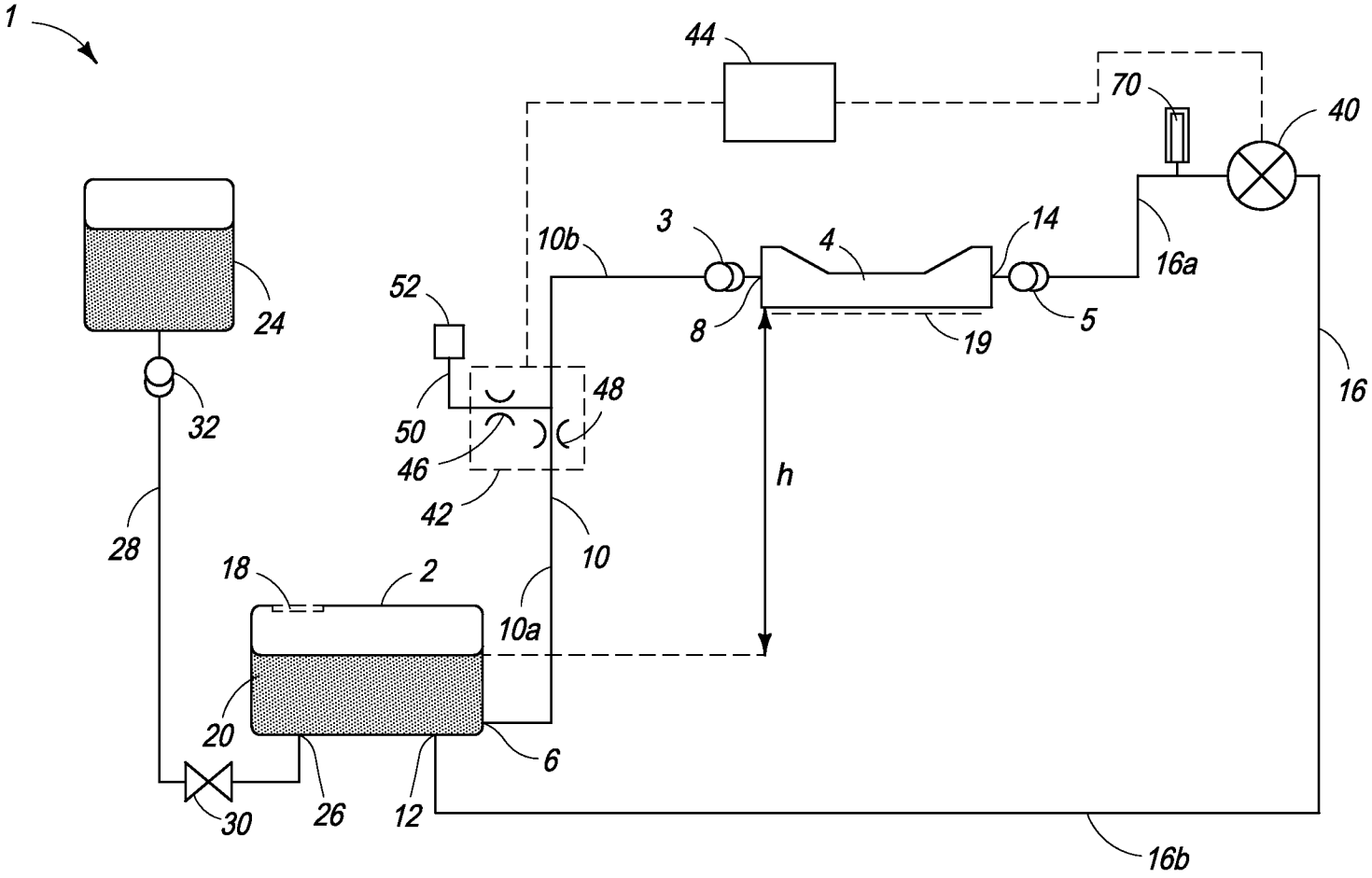
FIG. 1 (PRIOR ART)
FIG. 1 shows schematically a prior art inkjet printer as described in US2014/0009538.

Referring to FIG. 1, there is shown schematically a printer 1, as described in US2014/0009538 (the contents of which are incorporated herein by reference), having an ink delivery system for supplying ink to a printhead. The ink delivery system is similar in function to those described in US2011/0279566 and US2011/0279562, the contents of which are also herein incorporated by reference.

The printer 1 comprises an ink container 2 having a supply port 6 connected to a first port 8 of a printhead 4 via a first ink conduit 10. A return port 12 of the ink container 2 is connected to a second port 14 of the printhead 4 via a second ink conduit 16. Hence, the ink container 2, the first ink conduit 10, the printhead 4 and the second ink conduit 16 define a closed fluidic loop. Typically, the first ink conduit 10 and second ink conduit 16 are comprised of lengths of flexible tubing.

The printhead 4 is user-replaceable by means of a first coupling 3 releasably interconnecting the first port 8 and the first ink conduit 10; and a second coupling 5 releasably interconnecting the second port 14 and the second ink conduit 16. A more detailed description of the printhead 4 and its associated couplings can be found in, for example, US2011/0279566.

The ink container 2 is open to atmosphere via an air vent 18 in the form of an air-permeable membrane positioned in a roof of the ink container. Accordingly, during normal printing, ink is supplied to the printhead 4 at a negative hydrostatic pressure ("backpressure") under gravity. In other words, gravity-feeding of ink from the ink container 2 positioned below the printhead 4 provides a pressure-regulating system configured to supply ink at a negative hydrostatic pressure. The amount of backpressure experienced at the nozzle plate 19 of the printhead 4 is determined by the height h of the nozzle plate above the level of ink 20 in the ink container 2.

The pressure-regulating system typically further comprises some means for maintaining a substantially constant level of ink in the ink container 2 and, therefore, a constant height h and corresponding backpressure. As shown in FIG. 1, the pressure-regulating system comprises a bulk ink reservoir 24 connected to an inlet port 26 of the ink container 2 via a supply conduit 28 having a pressure-regulating valve 30. In some embodiments, the inlet port 26 and the return port 12 may be the same port of the ink container 2, with the second ink conduit 16 and the supply conduit 28 joined together.

The pressure-regulating valve 30 controls a flow of ink from the ink reservoir 24 into the ink container 2 so as to maintain a substantially constant level of ink in the ink container. As described in US2011/0279566, the valve 30 may be mechanically controlled by means of a float mechanism inside the ink container 2. However, it will be appreciated that other forms of valve control may be employed, such as an ink level sensor monitoring a level of ink in the ink container 2 in combination with a controller for electronically controlling operation of the valve 30 based on feedback from the ink level sensor.

The ink reservoir 24 is typically a user-replaceable ink cartridge connected to the supply conduit 28 via a supply coupling 32. Alternatively, and as described in US2011/0279562, the ink container 2 may itself be a user-replaceable cartridge. In other words, the ink reservoir 24, supply conduit and 28 and regulator valve 30 may be absent. When the ink container 2 is itself a user-replaceable cartridge, the height h may be maintained substantially constant by virtue of a slim or flattened height profile of the ink cartridge. A flattened height profile of the ink container 2 ensures minimal variations in the height h between full and near-empty ink cartridges.

The closed fluidic loop, incorporating the ink container 2, the first ink conduit 10, the printhead 4 and the second ink conduit 16, facilitates priming, de-priming and other printhead maintenance operations. The second ink conduit 16 includes a reversible peristaltic first pump 40 for circulating ink around the fluidic loop. Thus, the second ink conduit 16 has a third section 17*a* defined between the second port 14 and the first pump 40, and a fourth section 17*b* defined between the return port 12 and the first pump 40. By way of convention only, the "forward" direction of the first pump 40 corresponds to pumping ink from the supply port 6 to the return port 12 (i.e. clockwise as shown in FIG. 1), and the "reverse" direction of the pump corresponds to pumping ink from the return port 12 to the supply port 6 (i.e. anticlockwise as shown in FIG. 1).

The first pump 40 cooperates with a pinch valve arrangement 42 to coordinate various fluidic operations. The pinch valve arrangement 42 comprises a first pinch valve 46 and a second pinch valve 48, and may take the form of any of the pinch valve arrangements described in, for example, US 2011/0279566; US 2011/0279562; and U.S. application Ser. No. 14/097,499, the contents of which are incorporated herein by reference.

The first pinch valve 46 controls a flow of air through an air conduit 50, which is branched from the first ink conduit 10. The air conduit 50 terminates at an air filter 52, which is open to atmosphere and functions as an air intake for the closed fluidic loop. The first pinch valve 46 is positioned below a height of the nozzle plate in order to minimize ink drooling from printhead nozzles when the first pinch valve 46 is open.

By virtue of the air conduit 50, the first ink conduit 10 is divided into a first section 11*a* between the supply port 6 and the air conduit 50, and a second section 11*b* between the first port 8 and the air conduit 50. The second pinch valve 48 controls a flow of ink through the first section 11*a* of the first ink conduit 10.

The first pump 40, the first pinch valve 46 and the second pinch valve 48 are controlled by a controller 44, which coordinates various fluidic operations. From the foregoing, it will be appreciated that the ink delivery system shown in FIG. 1 provides a versatile range of fluidic operations. Table 1 describes various pinch valve and pump states for some example fluidic operations used in the printer 1. Of course, various combinations of these example fluidic operations may be employed.

TABLE 1

Example Fluidic Operations for Printer 1

| Fluidic Operation | Second Pinch Valve 48 | First Pinch Valve 46 | First Pump 40 |
|---|---|---|---|
| PRINT | open | closed | off |
| PRIME | open | closed | forward |
| STANDBY | open | closed | off |
| PULSE | closed | closed | reverse |
| DEPRIME | closed | open | forward |
| NULL | closed | closed | off |

During normal printing ("PRINT" mode), the printhead 4 draws ink from the ink container 2 at a negative backpressure under gravity. In this mode, the peristaltic first pump 40 functions as a shut-off valve, whilst the first pinch valve 46 is closed and the second pinch valve 48 is open to allow ink flow from the supply port 6 to the first port 8 of the printhead 4.

During printhead priming or flushing ("PRIME" mode), ink is circulated around the closed fluidic loop in the forward direction (i.e. clockwise as shown in FIG. 1). In this mode, the peristaltic first pump 40 is actuated in the forward pumping direction whilst the first pinch valve 46 is closed and the second pinch valve 48 is open to allow ink flow from the supply port to the return port 12 via the printhead 4. Priming in this manner may be used to prime a deprimed printhead with ink, or to flush air bubbles from the system. Flushed air bubbles are returned to the ink container 2 where they can be vented to atmosphere via the air vent 18.

In the "STANDBY" mode, the first pump 40 is switched off whilst the first pinch valve 46 is closed and the second pinch valve 48 is open. The "STANDBY" mode maintains a negative hydrostatic ink pressure at the printhead 4, which minimizes color mixing on the nozzle plate 19 when the printer is idle. Usually, the printhead is capped in this mode to minimize evaporation of ink from the nozzles (see, for example, US2011/0279519, the contents of which are herein incorporated by reference).

In order to ensure each nozzle of printhead 4 is fully primed with ink and/or to unblock any nozzles which have become clogged, a "PULSE" mode may be employed. In the "PULSE" mode, the first and second pinch valves 46 and 48 are closed, while the first pump 40 is actuated in a reverse direction (i.e. anticlockwise as shown in FIG. 1) to force ink through nozzles defined in the nozzle plate 19 of the printhead 4.

In order to replace a spent printhead 4, it is necessary to de-prime the printhead before it can be removed from the printer. In the "DEPRIME" mode, the first pinch valve 46 is open, the second pinch valve 48 is closed and the first pump 40 is actuated in the forward direction to draw in air from atmosphere via the air conduit 50. Once the printhead 4 has been deprimed of ink, the printer is set to "NULL" mode, which isolates the printhead from the ink supply, thereby allowing safe removal of the printhead with minimal ink spillages.

When the printer 1 is switched on or when the printer wakes up from an idle period (e.g. by being sent a new print job), the ink delivery system must ensure the printhead 4 is in a state ready for printing. Typically, this will involve a prime and/or a pulse operation, usually in combination with various other maintenance operations (e.g. wiping, spitting etc) depending, for example, on the period of time since the last print job. The printer may be set to "PRIME" mode relatively frequently in order to circulate ink around the closed fluidic loop.

As described in US2014/0009538, an air compliance chamber 70 may be positioned between the printhead 4 and the first pump 40 in fluid communication with the second ink conduit 16. The air compliance chamber 70 comprises an air-filled chamber, which dampens ink pressure fluctuations in the ink delivery system by compression of air. By positioning the air compliance chamber 70 close to printhead 4 (e.g. less than 100 mm from the printhead, less than 75 mm from the printhead, or between 30 and 60 mm from the printhead), the chamber has maximum effect in dampening ink pressure fluctuations experienced at the printhead nozzles, and therefore suppresses any undesirable flooding or gulping. Furthermore, the air compliance chamber 70 is positioned higher than the printhead 4 so as to function as a bubble-trap for any air bubbles, which have a natural buoyancy and tend to rise towards the highest point in the system.

Optimized Pulse Priming Architecture

Figure 2:
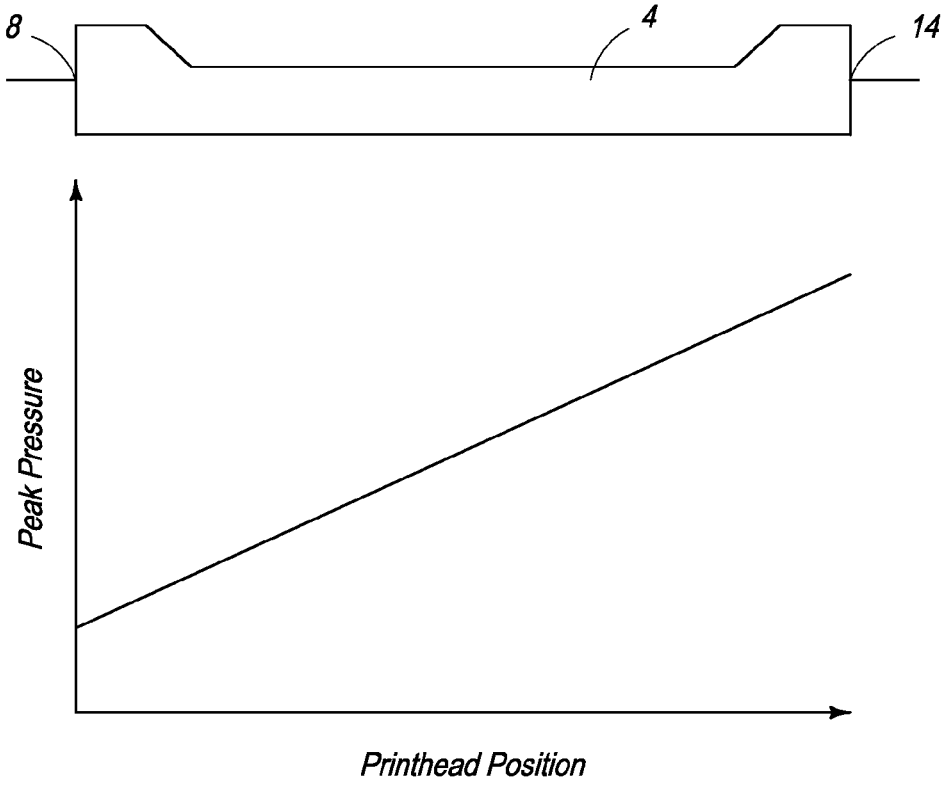
FIG. 2 is a schematic graph of a printhead pressure gradient during pulse priming for the printer shown in FIG. 1.

The "PULSE" priming mode described above in connection with the printer 1 ensures that each nozzle of the printhead 4 is fully primed with ink. However, a problem with the ink delivery system described above is that there is an inevitable pressure gradient from the second port 14 to the first port 8 of the printhead 4 during the "PULSE" priming mode. FIG. 2 shows schematically the pressure drop along the length of the printhead 4 from the second port 14 (maximum pressure) towards the first port 8 (minimum pressure).

This pressure gradient is undesirable, because nozzles near the first port 8 receive less priming pressure than nozzles near the second port 14. Depending on the physical characteristics of a particular ink (e.g. surface tension, viscosity etc.), the priming pressure experienced by nozzles near the first port 8 may be insufficient to properly prime those nozzles. The overall pressure across the printhead 4 may be increased by using a higher powered first pump 40 or two first pumps in parallel, but this measure is not ideal because priming is still inefficient and a relatively large amount of ink is wasted during the "PULSE" priming operation.

Figure 3:
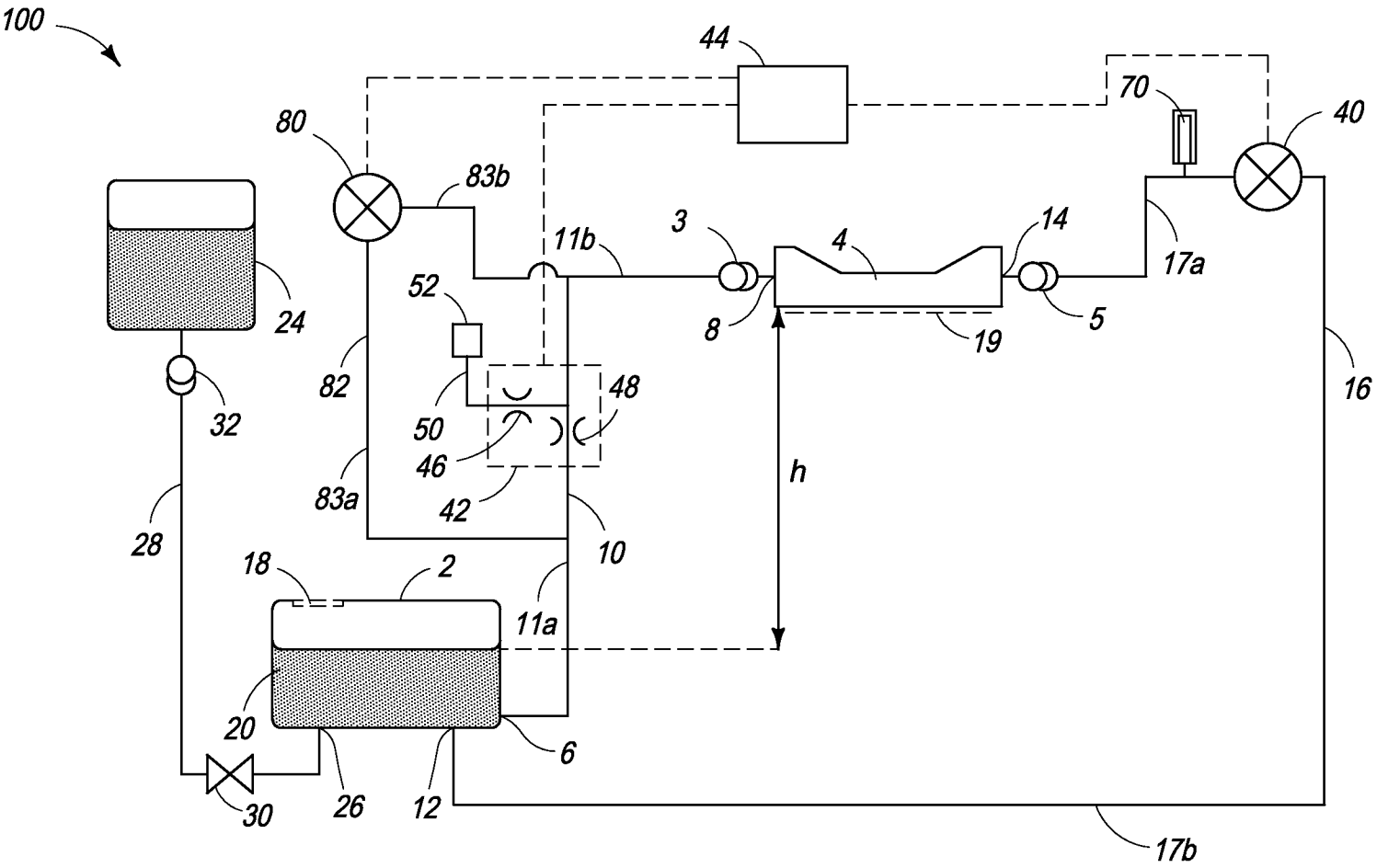
FIG. 3 shows schematically an inkjet printer according to the present invention.

FIG. 3 shows a printer 100 having an ink delivery system optimized for "PULSE" priming operations where ink is forced through all nozzles of the printhead 4 under positive pressure. The printer 100 is identical in all aspects to the printer 1 described in connection with FIG. 1, with the exception that a second pump 80 is in fluid communication with the first ink conduit 10 via a valve bypass conduit 82. For the sake of clarity, like reference numerals have been used to indicate like features in the printer 100 shown in FIG. 3 and the printer 1 shown in FIG. 1.

The second pump 80 operates in the forward direction only; that is, in a clockwise direction as shown in FIG. 3. The second pump 80 has a second pump inlet connected to the first section 11*a* of the first conduit 10 via a second pump inlet line 83*a*; and a second pump outlet connected to the second section 11*b* via a second pump outlet line 83*b*. The second pump inlet line 83*a* and second pump outlet line 83*b* are collectively referred to as the valve bypass conduit 82.

In some embodiments, an additional air compliance chamber (not shown in FIG. 3) may be connected to the second pump outlet line 83*b* by analogy with the air compliance chamber 70 connected to the second conduit 16. However, in the preferred embodiment shown in FIG. 3, an additional air compliance chamber is generally not required.

The second pump 80 is switched off for all maintenance operations other than the "PULSE" priming operation. By incorporating the second pump 80 on the valve bypass conduit 82, all other maintenance functions can be performed as described in Table 1. Typically, the second pump 80 is a peristaltic pump (preferably a non-reversible peristaltic pump), which shuts off the valve bypass conduit 82 when de-actuated. Preferably, the first pump 40 and second pump 80 have a same or similar pumping power.

Still referring to FIG. 3, the first pump 40, the second pump 80, the first pinch valve 46 and the second pinch valve 48 are controlled by the controller 44, which coordinates various fluidic operations. Table 2 describes various pinch valve and pump states for some example fluidic operations used in the printer 100. Of course, various combinations of these example fluidic operations may be employed.

TABLE 2

Example Fluidic Operations for Printer 100

| Fluidic Operation | Second Pinch Valve 48 | First Pinch Valve 46 | First Pump 40 | Second Pump 80 |
|---|---|---|---|---|
| PRINT | open | closed | off | off |
| PRIME | open | closed | forward | forward (slow) |
| STANDBY | open | closed | off | off |
| PULSE | closed | closed | reverse | forward |
| DEPRIME | closed | open | forward | off |
| NULL | closed | closed | off | off |

Comparing Tables 1 and 2, it can be seen that the second pump 80 is switched off for most fluidic operations.

Figure 4:
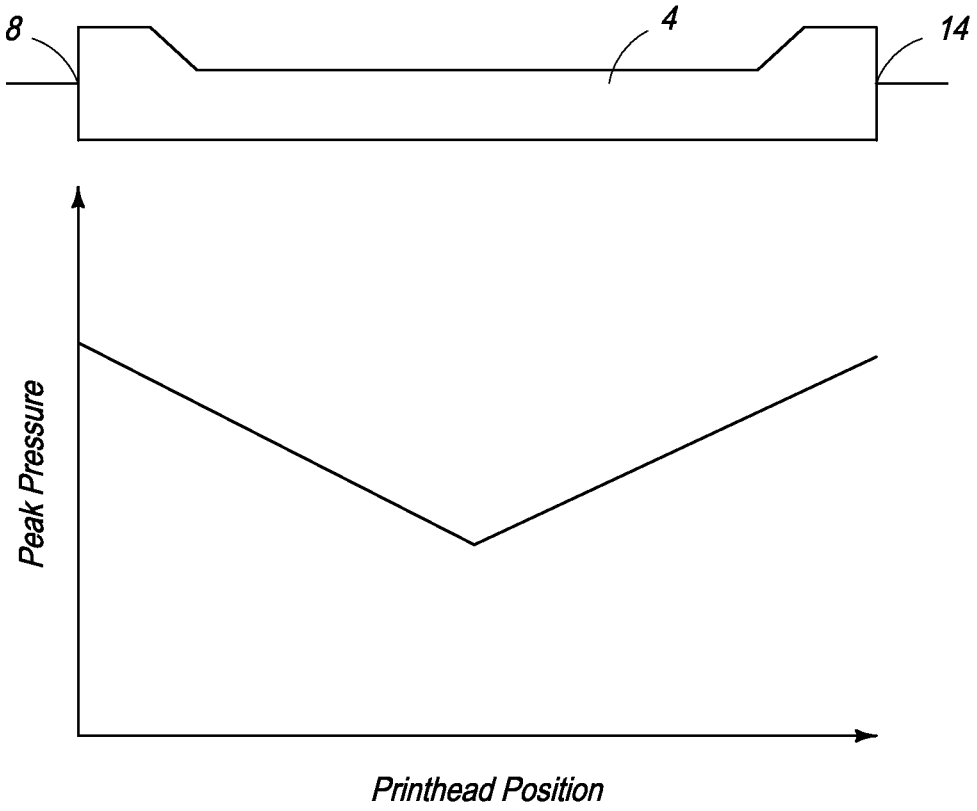
FIG. 4 is a schematic graph of a printhead pressure gradient during pulse priming for the printer shown in FIG. 3.

However, the "PULSE" prime operation is performed with the first pump 40 operating in the reverse direction (i.e. pumping ink towards the second port 14) and the second pump 80 operating in the forward direction (i.e. pumping ink towards the first port 8). Through the combined use of the first pump 40 and second pump 80, the pressure gradient along the length of the printhead 4 during the "PULSE" prime operation is as shown in FIG. 4. Thus, nozzles near the first port 8 and the second port 14 experience a maximum priming pressure, and nozzles around the middle of the printhead 4 experience a minimum priming pressure. Although there is still a pressure gradient from either end of the printhead 4 towards the middle of the printhead, the minimum priming pressure at the middle of the printhead in FIG. 4 is still greater than the minimum priming pressure at the first port 8 shown in FIG. 2. This results in more efficient printhead priming, less ink wastage, and lower power requirements for the pumps.

During the "PRIME" operation, the second pump 80 is typically actuated relatively slowly in a forward direction. For example, the first pump 40 may be actuated at about 170 rpm while the second pump is actuated relatively slower at about 20 rpm. Actuating both pumps during regular ink circulation operations advantageously ensures the valve bypass conduit 82 is primed with ink and, further, avoids any ink from stagnating in the valve bypass conduit and becoming a potential source of outgassed air bubbles in the system.

Optimized Pulse Priming Architecture for Multiple Printheads

Figure 5:
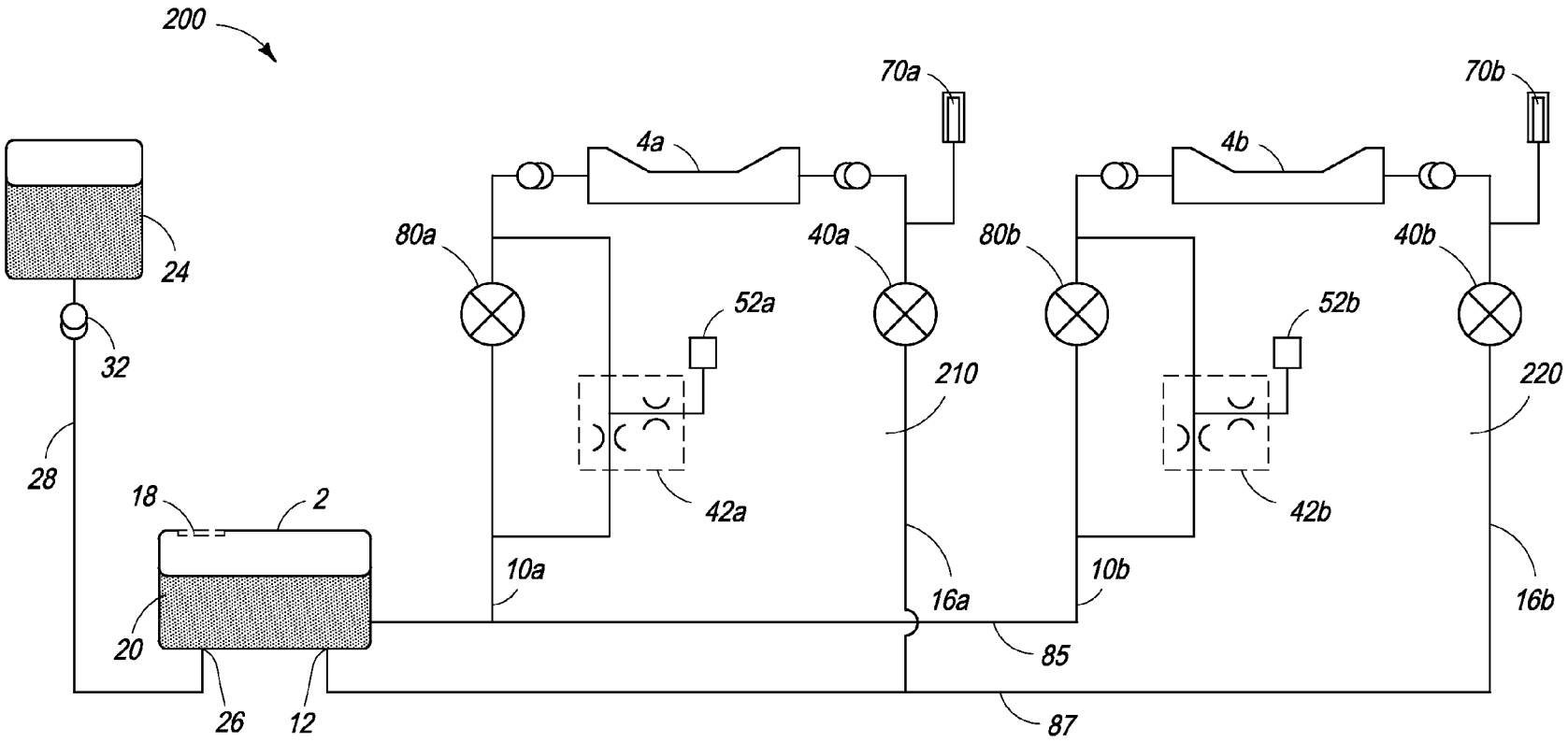
FIG. 5 shows schematically an alternative inkjet printer according to the present invention.

FIG. 5 shows a printer 200 having an ink delivery system for a first printhead 4*a* and a second printhead 4*b* connected in parallel to the ink container 2 via a common ink supply line 85 and a common ink return line 87. The printer 200 is configured for optimized "PULSE" priming operations of each printhead 4*a* and 4*b* by analogy with the printer 100 described in connection with FIG. 3.

For the sake of clarity, and unless otherwise stated, like reference numerals have been used to indicate like features in the printer 200 shown in FIG. 5 and the printers 1 and 100 shown in FIGS. 1 and 3, respectively.

Referring then to FIG. 5, the first printhead 4*a* receives ink via a respective first ink conduit 10*a* branched from the common ink supply line 85 and returns ink via a respective second ink conduit 16*a* branched from the common ink return line 87. Likewise, the second printhead 4*b* receives ink from a respective first ink conduit 10*b* connected to the common ink supply line 85 and returns ink via a second ink conduit 16*b* connected the common ink return line 87. Thus, the first and second printheads 4*a* and 4*b* have respective first and second fluidic loops 210 and 220 between the common ink supply line 85 and the common ink return line 87. It will be appreciated that any number of printheads may be connected in parallel in a similar manner, and the present invention is not particularly limited by the number of printheads connectable in this manner.

Each of the fluidic loops 210 and 220 has respective features corresponding to those features described above in connection with the printer 100 shown in FIG. 3. Thus, the first fluidic loop 210 for the first printhead 4*a* has a respective first pump 40*a*, a respective pinch valve arrangement 42*a* and a respective second pump 80*a* to control the various printing and priming operations described in Table 2. In particular, the combination of the second pump 80*a* and the first pump 40*a* of the first fluidic loop 210 enables optimized pulse priming of the first printhead 4*a* without unacceptable pressure drops at either end of the printhead. Other features of the first fluidic loop 210, such as the air filter 52*a* and air compliance chamber 70*a* are also entirely analogous with the corresponding features described above.

Likewise, the second fluidic loop 220 for the second printhead 4*b* has a respective first pump 40*b*, a respective pinch valve arrangement 42*b* and a respective second pump 80*b* to control the various printing and priming operations described in Table 2. And, of course, other features of the second fluidic loop 220, such as the air filter 52*b* and air compliance chamber 70*b* are also entirely analogous with the corresponding features described above.

From the foregoing, it will therefore be appreciated that an ink delivery system optimized for pulse priming of any number of printheads may be achieved using the principles described herein. Moreover, various methods of priming, depriming, printing etc, as described in Table 2, may be independently controlled for each of these printheads using their respective pinch valves and pumps.

It will, of course, be appreciated that the present invention has been described by way of example only and that modifications of detail may be made within the scope of the invention, which is defined in the accompanying claims.

The invention claimed is:

1. An inkjet printer comprising:

a printhead having a first port positioned towards a first end and a second port positioned towards an opposite second end;

an ink container for supplying ink to the printhead, the ink container comprising a supply port and a return port;

a first ink conduit interconnecting the supply port and the first port;

a second ink conduit interconnecting the return port and the second port;

an ink valve positioned in the first ink conduit for controlling ink flow between the ink container and the first port, wherein the first ink conduit has a first section between the ink container and the valve, and a second section between the valve and the first port;

a first pump positioned in the second conduit; and a second pump having a second pump inlet connected to the first section and a second pump outlet connected to the second section.

2. The inkjet printer of claim 1, wherein the first and second pumps are peristaltic pumps.

3. The inkjet printer of claim 2, wherein at least the first pump is reversible.

4. The inkjet printer of claim 1, wherein the ink container is positioned below a height of the printhead.

5. The inkjet printer of claim 1, wherein the ink container is open to atmosphere.

6. The inkjet printer of claim 1, further comprising:

an air conduit connected to the second section of the first ink conduit, the air conduit having an air inlet in fluid communication with atmosphere; and an air valve for controlling a flow of air through the air conduit.

7. The inkjet printer of claim 6, wherein the ink and air valves are contained in a multi-channel pinch valve arrangement configured for pinching at least one of: the air conduit and the second section of the first ink conduit.

8. The inkjet printer of claim 1 comprising:

at least first and second printheads;

a common ink supply line connected to the ink container; and a common ink return line connected to the ink container;

a first fluidic loop connecting the first printhead to the common ink supply line and the common ink return line via respective first and second ink conduits; and a second fluidic loop connecting the second printhead to the common ink supply line and the common ink return line via respective first and second ink conduits;

wherein each of the first and second fluidic loops comprises a respective first pump, second pump and ink valve.

9. The inkjet printer of claim 6, further comprising a controller for controlling operation of the first pump, the second pump, the ink valve and the air valve.

10. The inkjet printer of claim 9, wherein the controller is configured to coordinate a pressurized priming operation, the pressurized priming operation comprising the steps of:

closing the ink and air valves;

actuating the second pump to pump ink towards the first port of the printhead; and actuating the first pump in a reverse direction to pump ink towards the second port of the printhead, wherein the first and second pumps are actuated simultaneously.

11. The inkjet printer of claim 9, wherein the controller is configured to coordinate an ink circulation operation, the ink circulation operation comprising the steps of:

closing the air valve;

opening the ink valve; and actuating the first pump in a forward direction to draw ink from the supply port, through the printhead and towards the return port.

12. The inkjet printer of claim 11, wherein the controller is further configured to:

actuate the second pump in a forward direction, wherein the first pump has a higher pump speed than the second pump.

13. The inkjet printer of claim 9, wherein the controller is configured to coordinate a de-priming operation, the de-priming operation comprising the steps of:

opening the air valve;

closing the ink valve; and actuating the first pump only in a forward direction to draw air from the air conduit and through the printhead.

14. The inkjet printer of claim 9, wherein the controller is configured to close the air valve, open the ink valve and de-actuate the first and second pumps for a printing operation.

15. The inkjet printer of claim 1, wherein a first air compliance chamber communicates with the second conduit between the first pump and the second port.

16. The inkjet printer of claim 1, further comprising a pressure-regulating system for controlling a height of ink in the ink container relative to the printhead.

17. The inkjet printer of claim 16, further comprising an ink reservoir in fluid communication with the ink container, wherein the pressure-regulating system comprises a regulator valve for controlling a flow of ink into the ink container from the ink reservoir.

18. A method of pressure-priming a printhead having first and second ports positioned towards either end thereof, the method comprising the steps of:

pumping ink towards the second port using a first pump; and simultaneously pumping ink towards the first port using a second pump, wherein a minimum priming pressure is experienced by nozzles positioned at about the center of the printhead and a maximum priming pressure is experienced by nozzles positioned adjacent the first and second ports of the printhead.

19. The method of claim 18, wherein the printhead has a length of at least 200 mm.

20. The method of claim 18, wherein the first and second pumps have about a same pump speed.

* * * * *